US005387045A

United States Patent [19]

Anderson

[11] Patent Number: 5,387,045

[45] Date of Patent: Feb. 7, 1995

[54] RESERVOIR WAND

[76] Inventor: Ronald P. Anderson, 3655 W. Broadway, Robbinsdale, Minn. 55422

[21] Appl. No.: 148,001

[22] Filed: Nov. 5, 1993

[51] Int. Cl.[6] ..... A47L 1/08

[52] U.S. Cl. ..... 401/205; 401/206; 401/280; 401/281

[58] Field of Search ..... 401/205, 280, 281, 206, 401/207

[56] References Cited

U.S. PATENT DOCUMENTS

| | | | |
|---|---|---|---|
| D. 291,378 | 8/1987 | Viner . | |
| D. 298,072 | 10/1988 | Stirling . | |
| D. 320,490 | 1/1991 | Andrew, III et al. . | |
| 1,255,695 | 2/1918 | Blumenthal | 401/207 |
| 1,580,799 | 4/1926 | Anzalone | 401/281 |
| 2,708,763 | 5/1955 | Jacoby | 401/205 X |
| 2,745,127 | 5/1956 | Wulf | 401/281 |
| 4,050,111 | 9/1977 | Mallory . | |
| 4,152,807 | 5/1979 | Smahlik . | |

FOREIGN PATENT DOCUMENTS

| | | | |
|---|---|---|---|
| 90763 | 5/1896 | Germany | 401/206 |
| 639311 | 5/1962 | Italy | 401/206 |

*Primary Examiner*—Steven A. Bratlie
*Attorney, Agent, or Firm*—Hugh D. Jaeger

[57] ABSTRACT

A reservoir wand for use in the washing of windows where a supply of water is captured within the interior of the reservoir wand and subsequently dispensed to the exterior washing cloth of the wand.

1 Claim, 2 Drawing Sheets

RESERVOIR WAND

BACKGROUND OF THE INVENTION

1. Field of the Invention

The present invention pertains to cleaning equipment, and more particularly, relates to cleaning equipment used in cleaning of windows or other planar surfaces.

2. Description of the Prior Art

Prior art window cleaning devices, while functional, require constant re-wetting or re-dampening of a washing wand by re-immersion of the washing wand into a container of water when the dampness of the washing wand was degraded to a point where re-immersion was necessary. Also, when working from a ladder, frequent trips up or down the ladder were required when re-wetting of the washing wand was required, thus resulting in lost motion time and additional expense. Clearly, what is needed is a washing wand having improved re-wetting capabilities.

The present invention overcomes the shortcomings of prior art devices by providing a washing wand having an internal fluid reservoir.

SUMMARY OF THE INVENTION

The general purpose of the present invention provides a reservoir wand having an outer tube and close fitting inner reservoir tube contained within the outer tube.

According to one embodiment of the present invention, an inner tube is actuated within an outer tube to cause holes in the inner tube to align with corresponding holes in the outer tube. Water contained in the inner tube is then free to flow through the aligned holes to the exterior of the outer tube where the water or washing fluid is received by the porous washing cloth surrounding the outer tube. Filling of a liquid depleted reservoir wand is accomplished by aligning the holes in the inner and outer tubes, and immersing the reservoir wand in water to refill the interior by the aligned holes through fluid flow.

One significant aspect and feature of the present invention is a washing wand having an internal reservoir.

Another significant aspect and feature of the present invention is the incorporation of an internal inner reservoir tube.

Still another significant aspect and feature of the present invention is a spring which returns the internal inner tube to a rest or sealed position.

Yet another significant aspect and feature of the present invention is alignment of holes of inner and outer tube members and immersion to fill the reservoir wand.

A further significant aspect and feature of the present invention is the alignment of holes of inner and outer tube members to re-wet a surrounding washing cloth.

Having thus described one embodiment of the present invention, it is the principal object of the present invention to provide a reservoir wand for the washing of windows.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
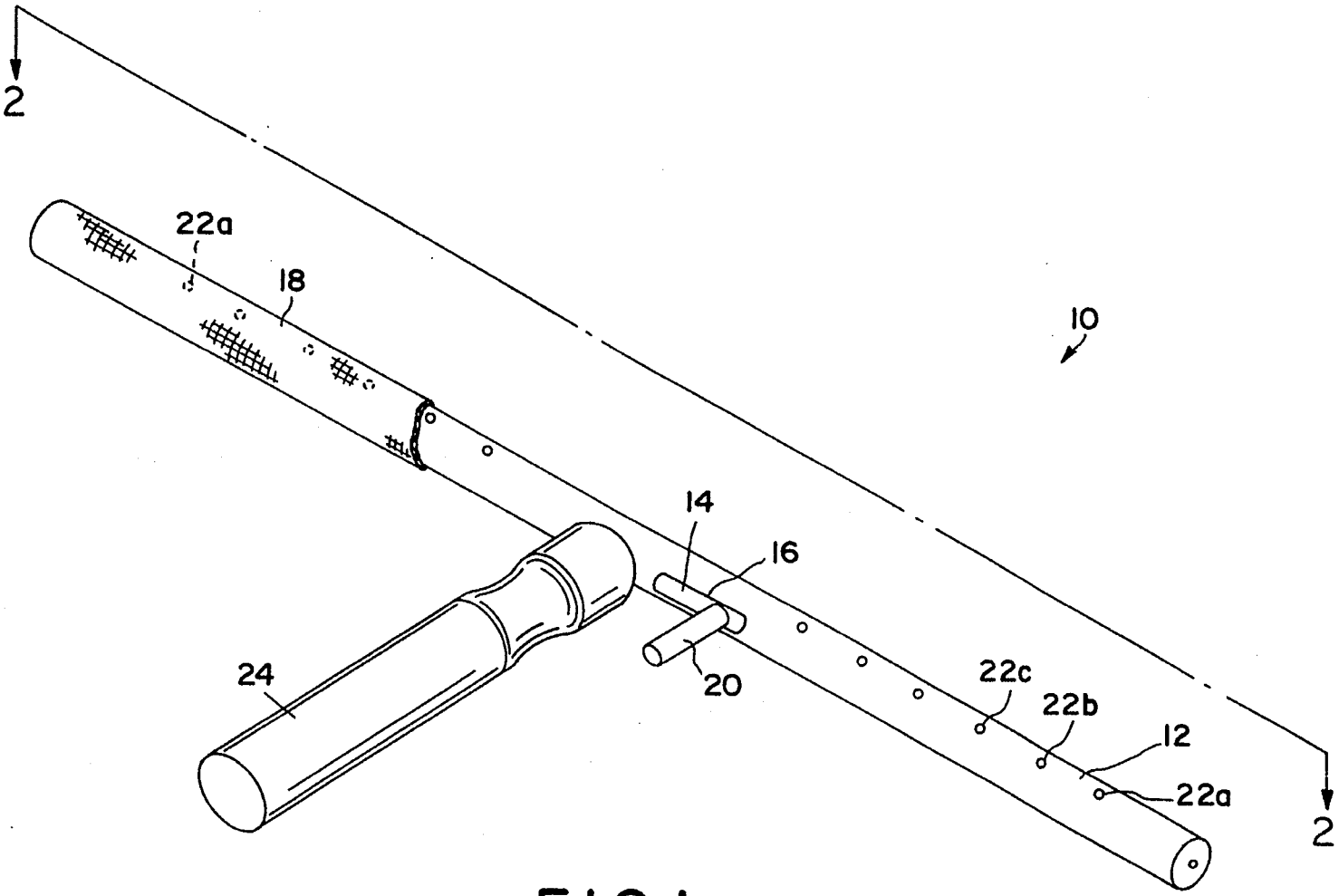
FIG. 1 illustrates a perspective cutaway view of a reservoir wand, the present invention.

FIG. 1 illustrates a perspective cutaway view of a reservoir wand 10 as used for window washing, including an outer tube 12, an inner tube 14 revealed through an elongated hole 16 in the side of the outer tube 12, a tubular washing cloth 18 fitted over and about the outer tube 12, an actuating lever 20 appropriately secured to the inner tube 14 passing through the elongated hole 16 in the outer tube 12, a plurality of spaced upper holes **22*a*–22*n* and a handle 24 appropriately secured to the outer tube 12**. Other pluralities of appropriately sized and spaced holes are described in detail in the FIGS that follow.

Figure 2:
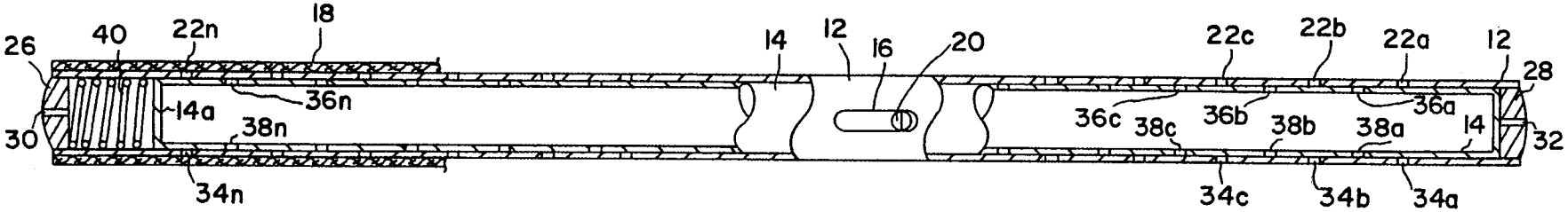
FIG. 2 illustrates a cross section view of the reservoir wand along line 2—2 of FIG. 1; and, FIG. 3 illustrates the inner tube actuated to align with holes in the outer tube.

FIG. 2 illustrates a cross section view of the reservoir wand 10 along lines 2—2 of FIG. 1 where all numerals correspond to those elements previously described. Illustrated in particular is the alignment of the inner tube 14 within the confines of the outer tube 12 where the inner and outer tubes 14 and 12 form a reservoir. The outer tube 12 includes end plugs 26 and 28 having vents 30 and 32 respectively located at opposing ends of the outer tube 12 as illustrated. Included also in the outer tube 12 are a plurality of spaced lower holes **34*a*–34*n* opposing spaced upper holes 22*a*–22*n*. The inner tube 14 is sealed at its ends and includes a plurality of spaced upper holes 36*a*–36*n* opposing a plurality of spaced lower holes 38*a*–38*n*. Holes 22*a*–22*n*, 34*a*–34*n*, 36*a*–36*n* and 38*a*–38*n* are similarly spaced. A spring 40 is located between the plug 26 and end 14*a* of the inner tube 14 to insure positioning of the tube toward the right interior of the outer tube 12 when the actuating lever 20** is in the unactuated position.

MODE OF OPERATION

Figure 3:
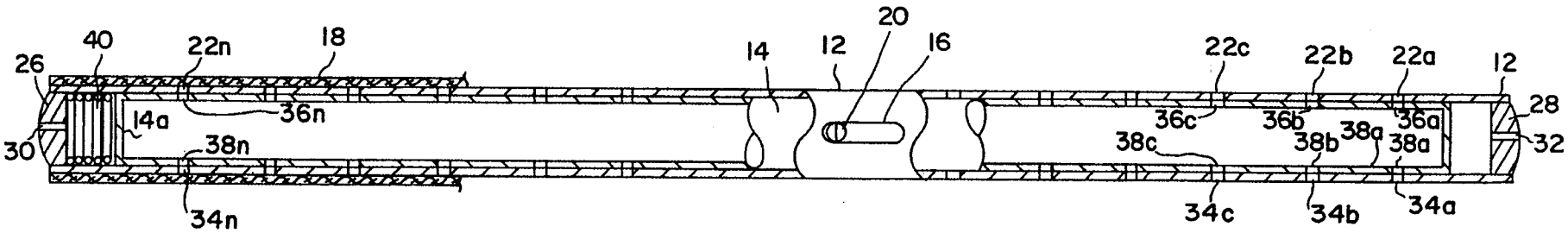

FIG. 3 illustrates the inner tube 14 actuated to the left by action of the actuating lever 20. Positioning of the inner tube 14 to the left and against the spring 40 causes the outer upper holes **22*a*–22*n* to align with the inner upper holes 36*a*–36*n* and the outer lower holes 34*a*–34*n* to align with the inner lower holes 38*a*–38*n* as illustrated. This position is incorporated when filling the reservoir wand 10 or for re-wetting the washing cloth 18. During the filling mode, the reservoir wand 10 is immersed in water or other cleaning medium. The water enters the interior of the inner tube 14 via the porous washing cloth 18 and the aligned hole set 22*a*–22*n* and 36*a*–36*n* and aligned hole set 36*a*–36*n* and 38*a*–38*n*. Subsequent to filling, the actuating lever 20 is released whereby the spring 40 causes the inner tube 14 to return to its at rest position against the plug 28. The inner tube holes 36*a*–36*n* and 38*a*–38*n* are sealed against the inner walls of the outer tube 12, thus encapsulating the water in the interior of the outer tube 12. Vents 30 and 32 prevent hydraulic locking of the inner tube 14 within the outer tube 12**.

Re-wetting of the washing cloth 18 is accomplished by positioning of the actuating lever 20 to the left to cause alignment of the holes **22*a*–22*n*** with holes

36*a*–36*n* and the alignment of the holes 34*a*–34*n* with holes 38*a*–38*n* for fluid flow. This alignment allows water contained in the interior of the inner tube 14 to flow through the aligned holes to re-wet the surrounding washing cloth 18 by fluid flow dynamics. The washing fluid can be a detergent such as Joy and water.

Various modifications can be made to the present invention without departing from the apparent scope hereof.

I claim:

1. A reservoir wand comprising:

a. an outer tube with a plurality of holes along a first axis and elongated hole adjacent a mid-point of said tube, and a handle affixed to a mid-point of said outer tube;

b. a vent hole at each end of said outer tube;

c. an inner tube with a plurality of second holes along a second axis for aligning with the first plurality of holes;

d. an actuating lever affixed to said inner tube; and, e. a spring between an outer end of said inner tube and an inner end of said outer tube whereby said spring biases said actuating lever against one end of said elongated hole for retaining the reservoir wand with a washing fluid and when said spring is compressed by biasing of said actuating lever, provides for filling of the reservoir wand with washing fluid for later wetting of a surrounding washing cloth which resides over a majority portion of said outer tube.

* * * * *